US006125952A

United States Patent [19]

Beccu et al.

[11] Patent Number: 6,125,952

[45] Date of Patent: Oct. 3, 2000

[54] PERCUSSIVE DOWN-THE-HOLE HAMMER AND A DRILL BIT THEREFOR

[75] Inventors: Rainer Beccu, Houston, Tex.; Bengt Åsberg, Åshammar, Sweden

[73] Assignee: Sandvik AB, Sandviken, Sweden

[21] Appl. No.: 09/261,615

[22] Filed: Mar. 3, 1999

[30] Foreign Application Priority Data

Mar. 3, 1998 [SE] Sweden ..... 9800646

[51] Int. Cl.[7] ..... E21B 4/14; E21B 10/38

[52] U.S. Cl. ..... 175/296; 175/417; 173/78

[58] Field of Search ..... 175/92, 106, 293, 175/296, 414, 417; 173/78, 204, 207

[56] References Cited

U.S. PATENT DOCUMENTS

| | | | |
|---|---|---|---|
| 4,878,550 | 11/1989 | Chuang | 175/296 |
| 5,131,476 | 7/1992 | Harrington | 173/17 |
| 5,435,402 | 7/1995 | Ziegenfuss | 175/414 |

*Primary Examiner*—Roger Schoeppel
*Attorney, Agent, or Firm*—Burns, Doane, Swecker & Mathis, L.L.P.

[57] ABSTRACT

In an air actuated down-the-hole hammer for rock drilling, a piston reciprocates within a casing to impact against a rear anvil surface of a drill bit. A foot valve extends axially between the piston and the drill bit. The anvil surface is inclined downwardly in a radially outward direction to cause liquid on the anvil surface to be discharged in a direction away from the foot valve, to prevent damage to the foot valve which could occur if piston impacts were able to create high-speed liquid streams contacting the foot valve.

12 Claims, 3 Drawing Sheets

PERCUSSIVE DOWN-THE-HOLE HAMMER AND A DRILL BIT THEREFOR

FIELD OF THE INVENTION

The present invention relates to a percussive down-the-hole hammer and a drill bit therefor.

PRIOR ART

During drilling with down-the-hole hammers under ground, such as in tunnels, the dust generated by the drilling operation often is bound together by the use of water mixed into the pressurized air driving the hammer and flushing the dust away. The down-the-hole hammer is provided with a plastic foot valve located in a central passageway in a drill bit anvil and projecting from the impact surface of the anvil. The foot valve is repeatedly enclosed by a central bore of the reciprocating piston to transfer spent pressurized driving air through the drill bit. When drilling downwardly, water is deposited on the impact surface between successive impacts such that each impact will create a jet stream of water away from the impact surface. The part of the jet stream traveling radially inwardly, however, will cut into the plastic foot valve and finally the valve will break such that the hammer will stop impacting.

In addition, often energy transfer from the piston to the drill bit is impaired by tolerance faults made during the production of these parts. Also, the known bits tend to break at the radially outer periphery of the anvil.

OBJECTS OF THE INVENTION

An object of the present invention is to provide a drill bit for a down-the-hole hammer which provide for extended lifespan of the foot valve, Another object of the present invention is to provide a drill bit for a down-the-hole hammer that will have a longer life between service than hitherto known hammers.

Still another object of the present invention is to provide a drill bit for a down-the-hole hammer that provides a good transfer of energy from the piston to the drill bit.

Still another object of the present invention is to provide a drill bit for a down-the-hole hammer that effectively resists breakage at the periphery of the anvil.

Still another object of the present invention is to provide a down-thehole hammer that is less sensitive to tolerance faults.

These and other objects of the drill bit and the down-the-hole hammer according to the present invention will become apparent from the following detailed description of a preferred embodiment thereof in connection with the accompanying drawings.

SUMMARY OF THE INVENTION

The present invention relates to an air actuated down-the-hole hammer for rock drilling. The hammer comprises a generally cylindrical casing which defines an axis. A drill sub is mounted to a rear end of the casing. A drill chuck is mounted to a front end of the casing. A drill bit is mounted in the drill chuck and includes a front cutting face and a rear anvil portion. The anvil portion includes a rearwardly facing anvil surface. The drill bit includes a first central passageway extending through the anvil surface. A piston is mounted in the casing behind the drill bit. The piston includes a forwardly facing impact surface and a second central passage extending through the impact surface and aligned with the first central passage. The piston is mounted for axial reciprocation toward and away from the drill bit, causing the impact surface to impact the anvil surface during a forward stroke of the piston. A foot valve extends partially in the first central passage and partially in the second central passage when the impact surface impacts the anvil surface, for transferring pressurized air from the second central passage to the first central passage. The anvil surface is inclined whereby a radially inner portion thereof is situated farther rearwardly than a radially outer portion thereof, for opposing thecreation of liquid streams tending to strike the foot valve when the impact surface impacts the anvil surface.

The present invention also relates to the percussive drill bit per se.

DESCRIPTION OF THE DRAWINGS

The objects and advantages of the invention will become apparent from the following detailed description of preferred embodiments thereof in connection with the accompanying drawing in which like numerals designate like elements, and in which.

DETAILED DESCRIPTION OF PREFERRED EMBODIMENTS OF THE INVENTION

Figure 1:
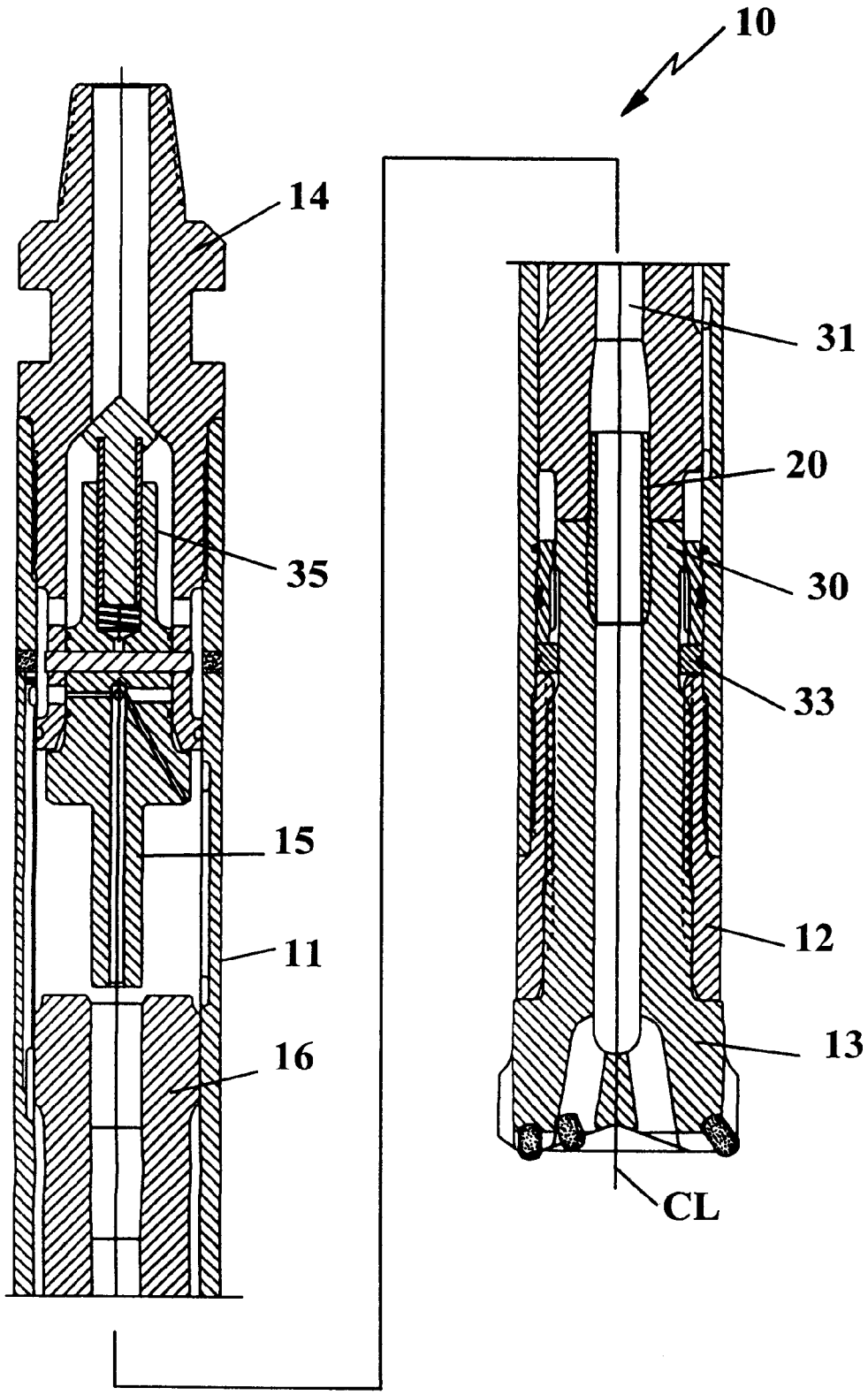
FIG. 1 shows a down-the-hole hammer according to the present invention in a longitudinal section.

In FIG. 1 there is shown a preferred embodiment of a down-the-hole hammer 10 according to the present invention. The hammer 10 comprises an outer cylindrical casing 11 connectable to a rotatable drill pipe string, not shown, through which compressed air is conducted. A hammer piston 16 reciprocates in the cylindrical casing 11, and compressed air is directed alternately to the upper (rear) and lower (front) ends of the piston to effect its reciprocation in the casing, each downward stroke inflicting an impact blow upon the anvil 30 of a drill bit 13 extending upwardly within the lower portion of the cylindrical casing. The piston comprises a passageway 31 for pressurized air. The percussive down-the-hole hammer further comprises a top sub 14, a check valve 35, a control or fluid feed tube 15, a foot valve 20, a retaining means 33 and a driver sub 12. The down-the-hole hammer 10 is of conventional design except for the shape of the anvil 30 of the drill bit 13. Usually the addition of water into the pressurized air for avoiding dust problems amounts to about 4 to 40 liters of water per minute.

The foot valve 20 (see FIG. 2) is of generally cylindrical basic shape and is made of plastics, such as nylon. The foot valve comprises a hollow tube 21 provided with a circumferential ridge 22 of a diameter larger than the diameter of the remainder of the tube 21. The ridge 22 is provided to keep the foot valve in the drill bit by being pressed into a corresponding circumferential groove 17 in a drill bit passageway 18. The foot valve 20 extends generally equally far into the drill bit and the piston 16 when the piston front surface 23 (impact surface) impacts on the drill bit rear surface 24 (anvil surface). The impact surface 23 connects to a circumferential chamfer 29 located at the orifice of the passageway 31 of the piston.

Figures 2, 3, 4:
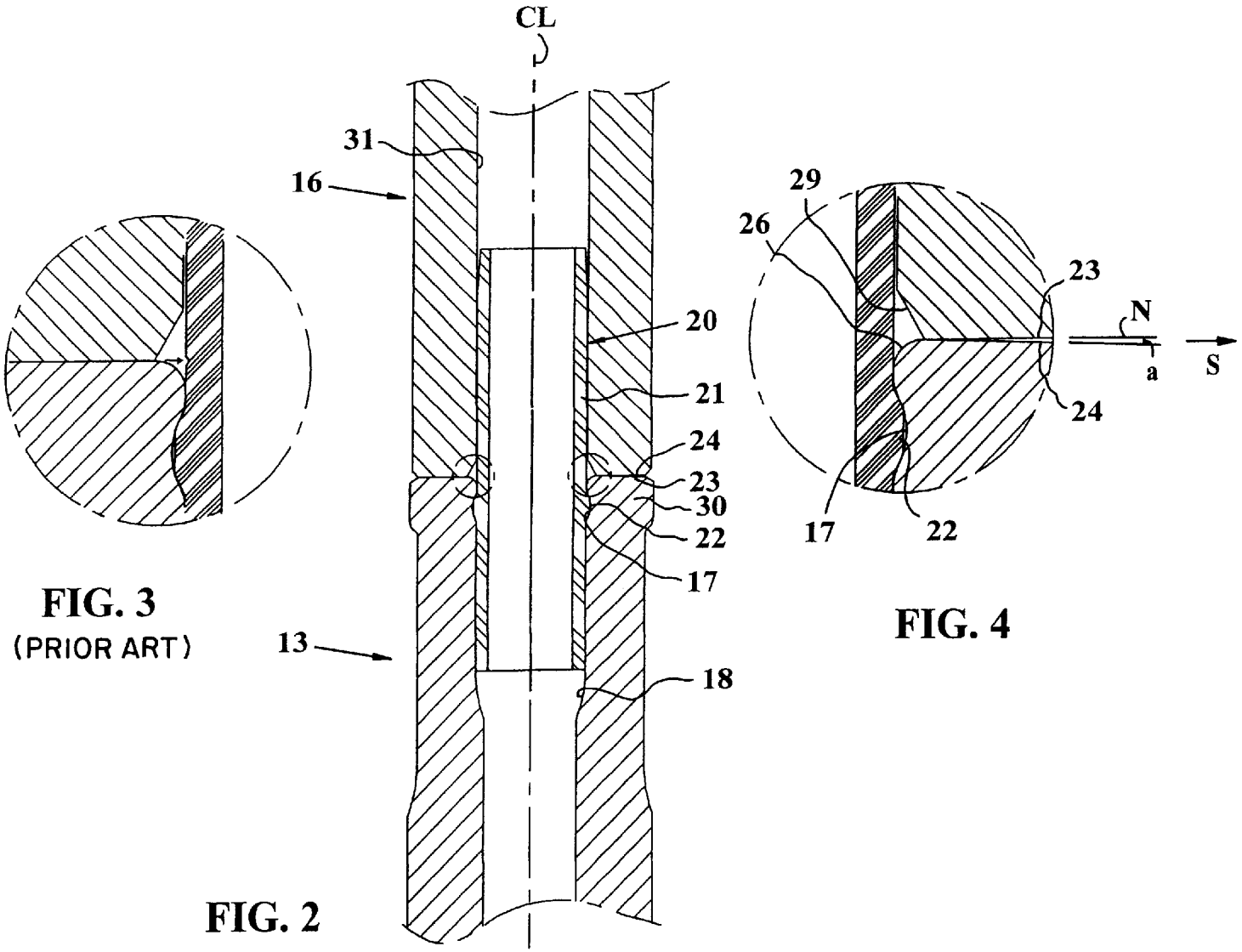
FIG. 3 (PRIOR ART)
FIG. 2 shows, in the left hand portion of that figure, a foot valve and portions of a drill bit according to the prior art and a piston, in a longitudinal section, and the right hand part thereof discloses the present invention.
FIG. 3 shows an enlarged view of the prior art portion of FIG. 2.
FIG. 4 shows an enlarged view of the right hand portion of FIG. 2 and the drill bit according to the present invention.

During drilling, when the piston 16 impacts the drill bit, the deposited water on the impact surface will create a jet stream of water, some of which travels in a radially inward direction indicated by the arrow in FIG. 3. That part of the jet stream has an angle of attack of about 90° with respect to the outer surface of the foot valve and will cut into the plastic foot valve and finally the valve will break. When the foot valve is broken there will not be any lower chamber present where pressurized air can assemble to lift the piston but instead the air will be transferred immediately through the drill bit passageway 18 and the hammer will not work.

Figure 5:
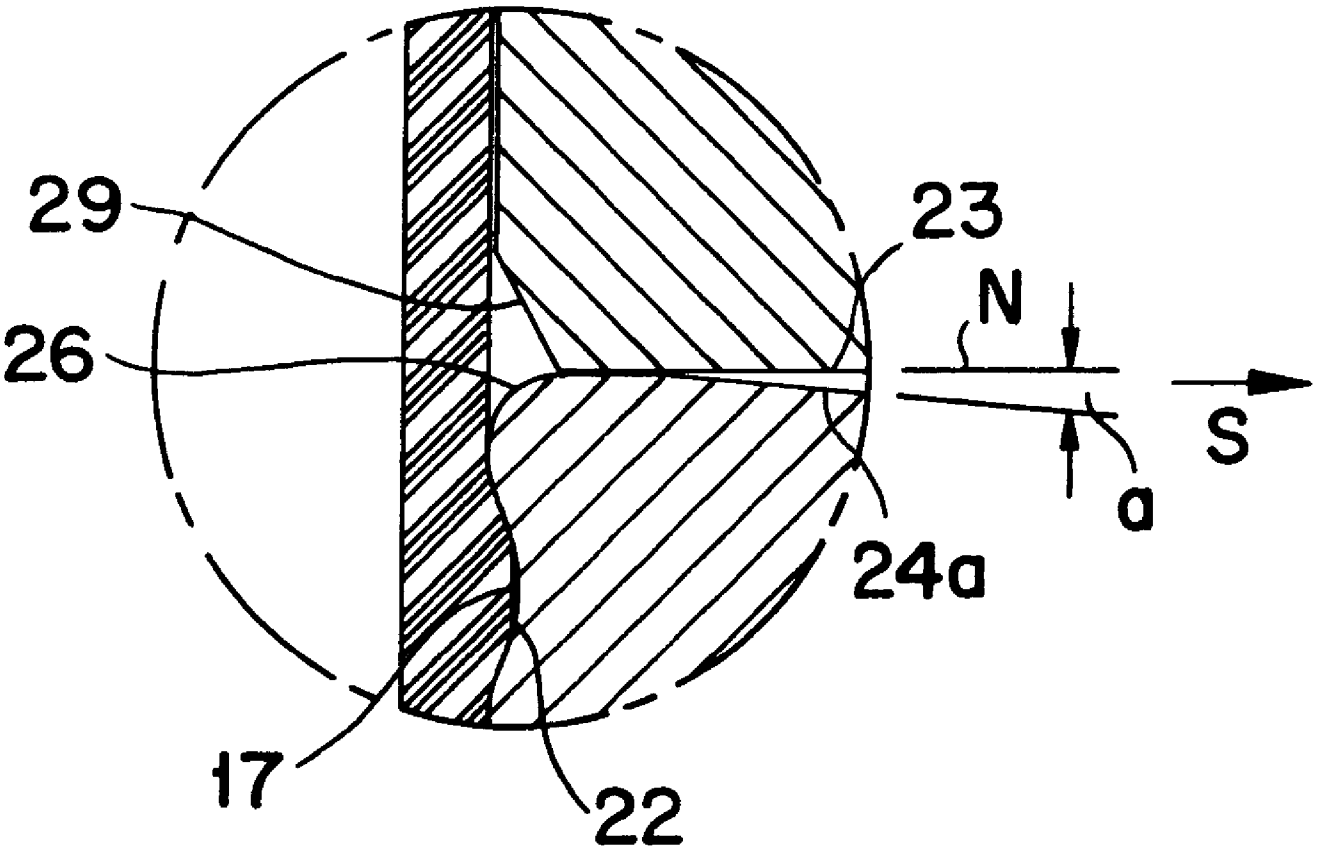
FIG. 5 is a view similar to FIG. 4 showing another embodiment of the invention.

Now looking at FIG. 4 there is presented a solution to the problem of jet stream damage to the foot valve. The anvil surface 24 of the drill bit according to the present invention has a convex shape, i.e., preferably by being generally conical (FIG. 4) or part-spherical (as shown at 24*a* in FIG. 5). That is, the surface 24 is slightly inclined, whereby a radially inner portion of the anvil surface is situated farther rearwardly (i.e., upwardly in FIG. 2) than a radially outer portion thereof. The piston front surface 23 preferably lies in a plane N extending perpendicular to a centerline CL of the hammer. Thus, the anvil surface forms an acute angle a with the normal N. The angle a is about 0.5 to 3°, preferably about 1°.

Since the anvil surface 24 has a downward slope in the radially outward direction, water will not collect on that surface, but rather tends to flow radially outwardly away from the impact area.

Furthermore, in the initial state of an impact, the radially inner portion of the surface 23 of the piston (close to the chamfer 29) will circumferentially contact the surface 24 of the bit and seal the impact area radially inwards. The piston 16 material is harder than the drill bit 13 material. Thus, as impact continues, an elastic deformation of the drill bit surface 23 will occur which allows the impact area to grow radially outwardly, thereby pushing any residual water radially outwards in the direction of the arrow S.

As a beneficial effect of the convex anvil surface 23, any tolerance faults caused during manufacture of the parts 13, 16 will not substantially move the initial impact area away from the relative central position shown in FIG. 4, i.e., the piston/drill bit unit will be self-centering. Such a central, circumferential impact location results in a better transfer of energy than an asymmetrical impact area. Furthermore, by controlling the impact to the radially inner parts of the bit, the bit will not break at the radially outer periphery of the anvil surface.

A drill bit according to the present invention will provide for an extended lifespan of the foot valve. Furthermore, a down-the hole hammer according to the present invention will have a more reliable function and better efficiency than hitherto known hammers.

Although the front surface 23 of the piston is disclosed as preferably lying in the plane N, it could instead be slightly convex similar to the surface 24, whereby the angle a would be slightly larger.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. An air-actuated down-the-hole hammer for rock drilling, comprising:

a generally cylindrical casing defining an axis;

a drill sub mounted to a rear end of the casing;

a drill chuck mounted to a front end of the casing;

a drill bit mounted in the drill chuck and including a front cutting face and a rear anvil portion, the anvil portion including a rearwardly facing anvil surface, the drill bit including a first central passage extending through the anvil surface;

a piston mounted in the casing behind the drill bit and including a forwardly facing impact surface and a second central passage extending through the impact surface and aligned with the first central passage, the piston mounted for axial reciprocation toward and away from the drill bit whereby the impact surface impacts the anvil surface during a forward stroke of the piston;

a foot valve extending partially in the first central passage and partially in the second central passage when the impact surface impacts the anvil surface for transferring pressurized air from the second central passage to the first central passage;

the anvil surface being inclined whereby a radially inner portion thereof is situated farther rearwardly than a radially outer portion thereof, for opposing the creation of liquid streams tending to strike the foot valve when the impact surface impacts the anvil surface.

2. The hammer according to claim 1 wherein the anvil surface is of generally conical shape.

3. The hammer according to claim 1 wherein the anvil surface is of partly spherical shape.

4. The hammer according to claim 1 wherein the anvil surface forms an acute angle with a normal to the axis.

5. The hammer according to claim 4 wherein the angle is from about 0.5° to about 3.0°.

6. The hammer according to claim 4 wherein the angle is about 1°.

7. A percussive drill bit for use in a down-the-hole hammer, comprising a front drilling face;

a rear anvil surface; and a central passageway extending through the anvil surface along a center axis of the drill bit;

the anvil surface being generally inclined, whereby a radially inner portion thereof is situated farther rearwardly than a radially outer portion thereof.

8. The drill bit according to claim 7 wherein the anvil surface is of generally conical shape.

9. The drill bit according to claim 7 wherein the anvil surface is of partly spherical shape.

10. The drill bit according to claim 7 wherein the anvil surface forms an acute angle with a normal to the axis.

11. The drill bit according to claim 10 wherein the angle is from about 0.5° to about 3.0°.

12. The drill bit according to claim 10 wherein the angle is about 1°.

* * * * *